US005137274A

United States Patent [19]

Soong

[11] Patent Number: 5,137,274

[45] Date of Patent: Aug. 11, 1992

[54] EXTENSIBLE GROMMET STRIP FOR SPORTS RACKETS

[76] Inventor: Tsai C. Soong, 1839 Jackson Rd., Penfield, N.Y. 14625

[21] Appl. No.: 792,393

[22] Filed: Nov. 5, 1991

[51] Int. Cl.[5] ..... A63B 49/00

[52] U.S. Cl. ..... 273/73 R; 273/73 D

[58] Field of Search ..... 473/73 R, 73 C, 73 D, 473/73 E

[56] References Cited

U.S. PATENT DOCUMENTS

| | | | |
|---|---|---|---|
| 4,697,811 | 10/1987 | Muroi | 273/73 C |
| 4,889,337 | 12/1989 | Todd | 273/73 D |
| 5,029,859 | 7/1991 | Davis | 273/73 R |

FOREIGN PATENT DOCUMENTS

| | | | |
|---|---|---|---|
| 0130622 | 1/1985 | European Pat. Off. | 273/73 R |
| 2607397 | 6/1988 | France | 273/73 R |

*Primary Examiner*—Benjamin Layno
*Assistant Examiner*—Raleigh W. Chiu
*Attorney, Agent, or Firm*—Bernard A. Chiama

[57] ABSTRACT

An extensible grommet strip used in sports rackets is disclosed as having a strip connecting a multiple of grommets along its length, each grommet having a flaring end being connected to the strip, and a stem having an inside hole for passing the string, the hole has its axial axis coinciding with the axis of the strip and a perpendicular axis perpendicular to the axial axis. Each of the grommets has cutouts associated therewith, whereby cutouts create at least one elongated opening at each side of the grommet, generally parallel to the perpendicular axis, leaving an isolated grommet connected to the strip only through bridging material on either side of the axial axis which links the grommet to that side of the strip.

15 Claims, 4 Drawing Sheets

EXTENSIBLE GROMMET STRIP FOR SPORTS RACKETS

This is a continuation application of application Ser. No. 07/630,007, filed Dec. 19, 1990, now abandoned.

BACKGROUND OF THE INVENTION

In sports racket frames, holes for passing strings through the frame are drilled in the frame and the string is protected from the sharp edges of the holes by a grommet for each hole. The grommet is made of plastic, having a flared end which admits the string into the interior of the frame, and a stem of constant diameter which leads the string and exits the same to the string network area. The grommets are connected at the flared end by a common strip and the assembly is called a grommet strip. For a grommet strip used in the nose region, called a guard strip, its center is recessed so that the string is protected from scratching and its lateral sides are widened to be about the width of the frame so that the nose region is protected from damage if the racket hits the ground during the play.

In the prior art, the conventional bumper/grommet strip arrangement, as described in U.S. Pat. No. 4,204,681, grommets formed in a grommet strip extend into holes formed in a racket frame and grommets formed on a bumper strip extend into holes formed in the grommet strip. There is no provision for permitting the sidewise displacement of any of the grommets to match up with its associated hole in the event of their misalignment.

In U.S. Pat. No. 4,776,592, there is described an exteriorly mounted member having tubular sleeves adapted to be inserted into string holes formed in a racket frame. There is no provision for overcoming the situation wherein one or more of the tubular sleeves are misaligned relative to the string holes. Another arrangement for supporting stringing grommets in a sports racket is disclosed in U.S. Pat. No. 4,496,152. In this arrangement, individual grommets are pressed into holes formed in the racket frame, thereby eliminating the use of a grommet strip altogether.

There are two problems associated with the prior art. One problem is that the center-to-center distance between the grommets in a strip cannot be precisely the same as the distance between the corresponding holes in the frame. This discrepancy often causes considerable difficulty in the stringing of the frame. The guard strip is difficult to stretch to make up for the mismatch between the holes and the grommets because of its stiffness. The smoothness in having the guard strip inserted into the frame with relative ease is a measure of the quality of the molding of the guard strip and the drill jig of the frame. However, it is a costly demand of workmanship.

The second problem is damping of the frame head involving the guard strip. A convenient location for a damping layer is at the interface between the frame and the guard strip. However, since the grommets lodged the guard strip firmly against the recess in the frame preventing it from any axial lengthwise movement between neighboring grommets, the damping layer imbeded between the strip and the surface of the frame will have to move together with the frame as a thick beam during vibration. This prevented any damping effect the damping layer might have contributed to the suppression of the vibration of the frame. The present invention of a new strip improves on that as will be discussed below.

The present extensible grommet strip has the grommets partially isolated in the strip which allows the individual grommets to move relatively easily toward each other so that when the frame holes are not aligned exactly, the grommets can accommodate the mismatch without difficulty.

DESCRIPTION OF THE PREFERRED EMBODIMENT

Figure 2:
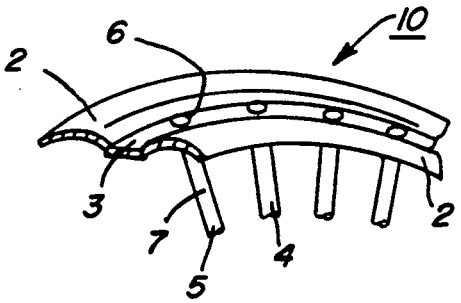
FIG. 2 shows a conventional guard strip.

The conventional guard strip is shown in FIG. 2 where the guard strip 10 has lateral wings 2, and a center strip 3 which connects grommets 4 and 5. The distance between the grommets 4 and 5 may be varied. The flared end 6 of the grommets 5 has a curved inlet to guide the string, which is not shown, into the grommet stem 7 and exits into the string network of the frame. Since the guard strip has to cover a generally circular frame, it takes some effort to insert the long grommets into their respective holes which are not parallel to each other. The task is much more troublesome if the center distance between holes does not exactly match that between the respective grommets. In fact, if the distance between holes is out of alignment for even a fraction of a millimeter, there is no way the strip can be inserted easily. The only way an out-of-alignment guard strip can be inserted into the frame is by redrilling the mismatched holes to a larger diameter.

Figure 1:
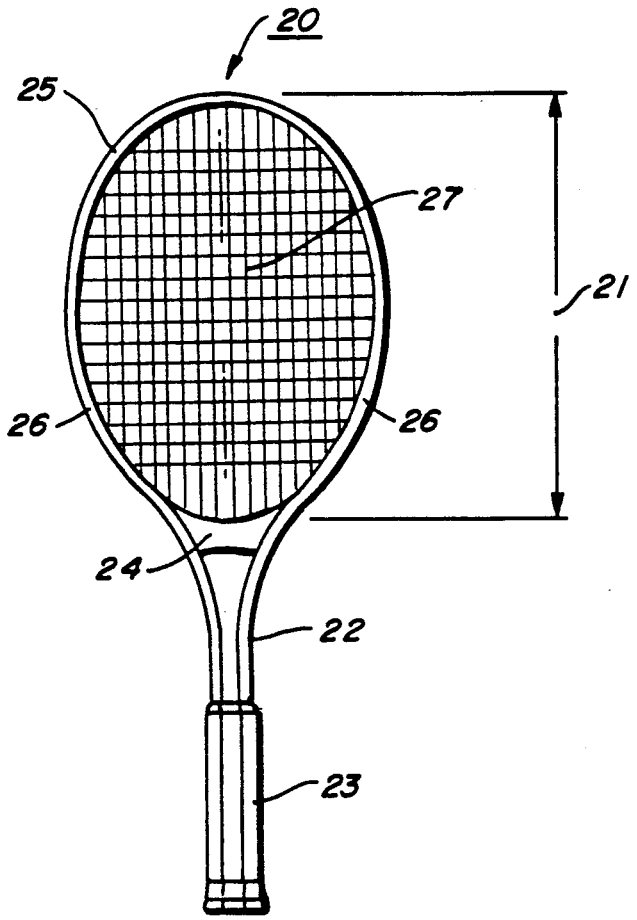
FIG. 1 shows a conventional sports racket frame with handle.

FIG. 1 shows a conventional sports racket. Racket 20 comprises a frame head 21, shank 22 connecting the head to the handle 23, and a throat 24 between the head and the shank. The nose 25 is where the guard strip is used to protect the frame. The nose, the two side frames 26 which are generally parallel to the axis of the racket and the throat 24 constitute the boundary of the head which contains the string network 27. The extensible grommet strip of the present invention may be used at the nose only or at the nose and the side frames and the throat.

Figure 3:
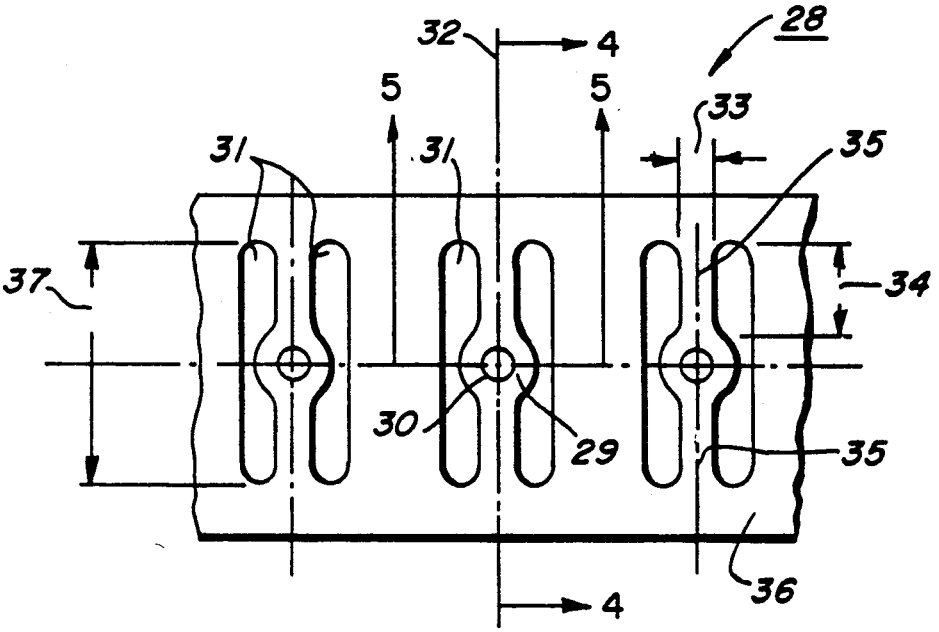
FIG. 3 is a plan view of an extensible guard strip the present invention.
Figure 4:
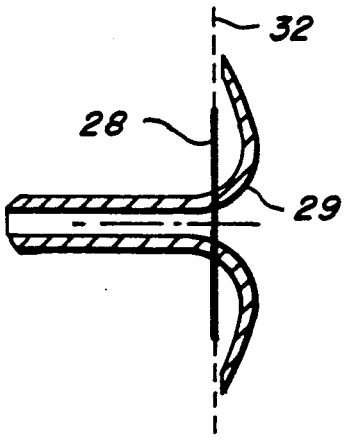
FIG. 4 is a cross-sectional view taken along the line 4—4 in FIG. 3.
Figure 5:
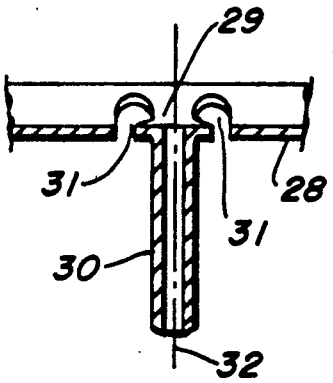
FIG. 5 is a cross-sectional view taken along the line 5—5 in FIG. 3.

FIG. 3 shows an embodiment of an extensible grommet strip indicated at 28. Its cross section in FIG. 4 along the line 4—4 in FIG. 3 shows a conventional cross section of a grommet strip with a flared end 29. If the grommet strip 28 is used as a guard strip, the width is larger. The cross section in FIG. 5 of the strip along the line 5—5 shows the significant difference of the strip of the present invention and the conventional strip. As distinguished from the conventional grommet strip, the strip 28 of the present invention is formed with transverse cutouts 31, one on either side of a plane coincident with the perpendicular axis 32 of the strip 28 and normal thereto. The cutouts 31 for each hole is such that the flared end 29 of the stem 30 is partially isolated in its connection with the strip.

Figure 8:
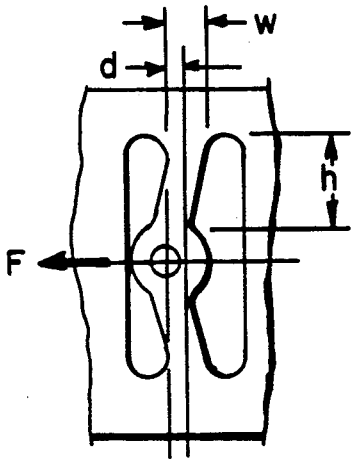
FIG. 8 shows a grommet moved a small distance d by a force F.

Various shapes of the cutouts are possible. These will determine the shapes of the connections of the grommets to the strip. The cutout for the isolation of the flared end 29 is preferably along each side of the perpendicular axis 32 of the strip 28. This axis 32 is one of the orthogonal axes passing through the center of the hole at the flared end 29. The shape is such that most of the flared material at the end is retained so that the string, not shown, is guided smoothly into the stem. The width 33 and the length 34 of the connecting bridge 35 are dimensioned to maintain sufficient structural connectivity between the stem 30 and the sides 36 of the strip, yet is isolated enough to allow the stem to be displaced easily along the axis of this strip, as shown in FIG. 8, to accommodate the said mismatch of the spacing of holes without too much force or damage to the stem.

The beginning of the length 34 is measured close to the nearest edge of the stem. The length of 34 is preferred to be at least one and a half times the average width 33. Otherwise, the grommet will be too stiff to be moved. The length of 37 of the cutouts 31 is preferred to be at least three times the average width 33 plus the diameter of the stem of the grommet. The contour of the cutout may be varied from what is shown in FIG. 3, but the requirement that the length be at least three times the average width should be maintained.

Figure 6:
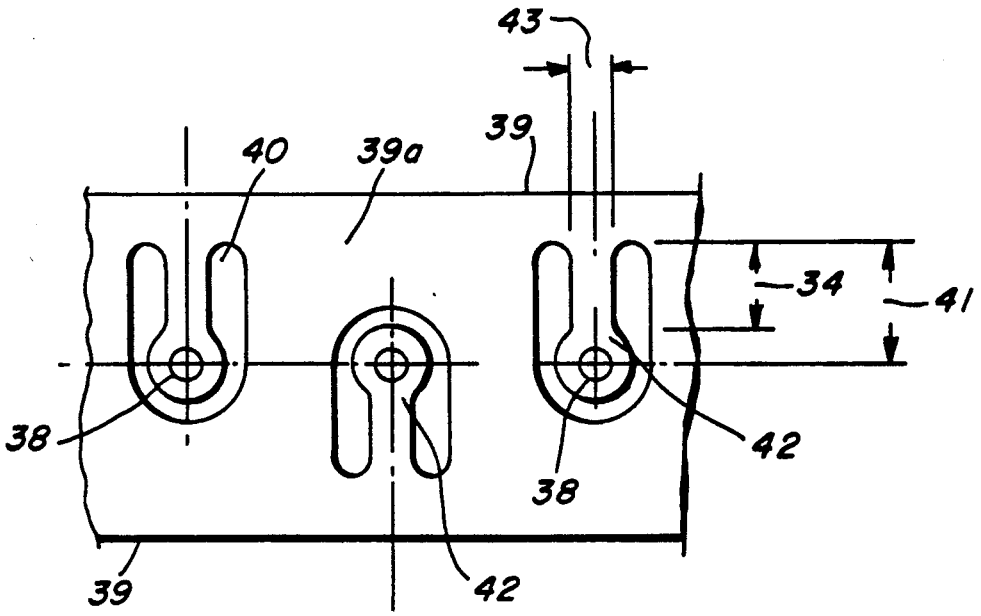
FIG. 6 shows another embodiment of the connection of a grommet to a grommet strip.

Another embodiment of the shape of the cutouts is shown in FIG. 6 wherein the grommets 38 are alternately connected to the sides 39*a* of the grommet strip 39 and the cutouts 40 are generally U-shaped. In this embodiment, the length 41 of the bridge 42 from the center of the hole of the grommet 38 is at least one and a half times the average width 43 plus the radius of the stem 38. In the FIG. 6 embodiment, the sides of the strip 39 has more support from the connection remaining with the grommet than for the embodiment in FIG. 3.

Figure 7:
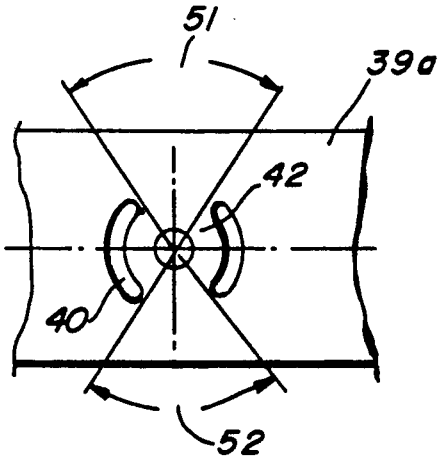
FIG. 7 is a schematic illustration of the cutouts in FIG. 6 in relation to the grommet bridging material.

FIG. 7 defines the subtended arc angle 51 and 52 of the bridging material 42. It shows the two parallel cutouts 40 embracing opposite subtended arc angles 51 and 52. The total arc is the sum of individual arcs which defines in a gross way how much the grommet is connected with the rest of the strip. For a completely cutoff grommet, the total subtended arc is zero. The longer the bridge material, the less will be the arc angle. If the total arc angle is 180 degrees, the grommet is connected with the strip 39 only along one half of its circumference, which may be taken as the maximum an extendable grommet should remain in connection with the rest of the strip.

To understand the importance of dimensions, the following is an analysis of a grommet strip for a tennis racket. FIG. 8 shows a part of a strip with a displaced stem. The force F required to displace the center of the hole to a distance of d with the said bridge of width w, thickness t, and length h is, according to the mechanics all of these dimensions being in mm:

$$F=24EB/h^3 \quad (1)$$

where E is Young's modulus and B is its bending moment of inertia which is equal to $tw^3/12$. Equation (1) depicts a center loaded beam of length $2h$ with both ends clamped. Assuming the strip 39 is plastic, whose Young's E is about $1.66KN/mm^2$, where one KN(Kilonewton) is equal to 225 pounds (lbs) of force and that the maximum displacement d required for accommodating the mismatch of neighboring holes is d=0.5 mm for a tennis racket frame, then Eq.(1) becomes $$F=1.66tw^3/h^3 \quad (2)$$

For a conventional guard strip with average thickness of t=0.8mm, with a bridge width w=2.0 mm and length h=5.0mm, the lateral force on the stem, according to Eq.(2), is calculated as F=0.085KN This is approximately equal to 19.1 pounds of force. This is a reasonable force to forcefully push the grommet to the corresponding hole that is 0.5 mm away from the correct hole center in the frame. Without this extensibility to move the stem, this misalignment will certainly break the stem or buckle the strip because the strip is too stiff to budge.

Figure 9:
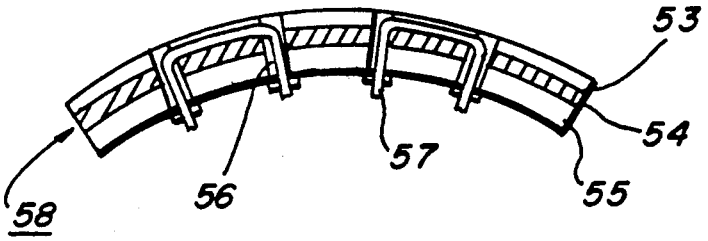
FIG. 9 shows a damping layer sandwiched in between the grommet strip and the frame.

A recently developed effective damping technique of vibration of plates by the so-called constrained damping is shown in FIG. 9. In this example, the three layered beam in FIG. 9 comprises a vibration unit: the strip 53, the middle damping layer 54 and the frame 55. In the ordinary case, when the grommet is fixed to the strip and the stem 56 extends into the frame with a strong string 57 binding the upper and lower layers together, the three layers will vibrate together as a single thick beam of three layers. In the conventional case, when the frame bends, the middle and the upper layers will bend with it as a thick beam. The middle damping layer which can only stretch along its length is not effective to absorb strain energy for damping because it is in the neutral axis of the thick beam.

However, if the stem 56 is isolated as shown in FIG. 3 by the cutouts 31, the bending of the frame 55 cannot compress the upper strip 53 as a rigid beam would. The curvature change of the upper strip has to go through the middle layer by shear stress in the interface 58 between the strip and the damping layer. Now the damping layer not only stretches more effectively but also has considerable shear stress. This makes damping more effective. Furthermore, the inplane stiffness of the strip 53, resisting to be stretched, will react to the bending from the frame negatively and help to reduce the amplitude of bending of the frame. This is the so-called constraining layer effect, that is, the upper strip constrains the lower frame through the middle damping layer by means of the upper strip 53.

The damping layer 54 may be applied to the surface of the strip 53 using adhesive material which form of attachment greatly improves the damping effect. Taking advantage of the grommet strip for the additional damping of the frame, made possible by the isolation of the grommet, is an improvement not seen before in the prior art. With such an extensible grommet strip having a damping layer attached and surrounding all the length of the head of the frame as shown in FIG. 1, the racket frame will be the most damped frame possible to an extent not seen in the prior art.

In the art of damping layers for sports rackets of the type wherein a layer of damping material is applied to a racket frame with grommet stems extending therethrough, the grommet stems are rigidly connected to and between frame layers or members so that the damping layer will not be able to provides its most efficient damping function, if at all. Effective damping is thereby lost because the frame layers and the damping layer will vibrate together as a single thick beam, as described above.

As can be seen from the above described computation by means of Eq. (2), the force F to move the stem depends on the width w, the length h and the strip's thickness t. For a tennis racket frame using a plastic grommet strip, for average strip thickness t about 0.6 mm to 1.0 mm, distance from the center of the hole to the edge of the cutout parallel to the axis of the bridge is preferred not less than about 3.0 mm and a preferred average width 33 of the bridge to be not more than about 4.0 mm.

Various other modifications that would occur to a skilled workman in the field may be assumed to come within the scope of the following claims. For example, the damping layer may be made as a composite structure with a grommet strip, as devised in accordance with the invention. Also in the alternative, instead of using cutout openings for isolating the grommet stems to permit their movement along the axial axis of a grommet hole, which is the preferred mode, the grommet stems may be made to move axially by the use of flexible membranes, or the like, between the flared ends thereof and its support strip.

What is claimed is:

1. An extensible grommet strip for use in a sports racket having holes formed therein and a string network supported thereon, comprising a strip having a plurality of grommets along its length, at least one of said grommets having a circular end connected to said strip and a stem having an inside hole for passing a string of the string network, said circular end having a first axis coinciding with the longitudinal axis of said strip, a second axis perpendicular to said first axis of said end, and a third axis orthogonal to said first and second axes passing through the center line of said stem, said strip being formed with cutouts defining at least one elongated opening adjacent to and along a portion of the circumference of said grommet whereby said strip is being formed with a bridging portion connected between said strip and said grommet thereby partially isolating the grommet from the strip and permitting offset movement of said grommet along said first axis of said circular end.

2. The grommet strip in claim 18 wherein said cutouts are formed partially around the circumference of said grommet to partially isolate the grommet from the strip.

3. The grommet strip in claim 2 wherein said partially isolated grommet is connected to the rest of the strip at its circumference around the hole for a total subtended arc angle not more than 180 degrees.

4. The grommet strip in claim 2 wherein said cutouts define at least one elongated opening around the circumference of the grommet, have an elongated opening at each side of the grommet generally parallel to said second axis and leave said partially isolated grommet connected to the strip through at least one bridging portion which links the grommet to the rest of the strip.

5. The grommet strip in claim 4 wherein the length of said cutouts nearest to the grommet measured from the center of the hole to the edge of the opening nearest to the side of the strip along the direction parallel to said second axis is at least the product of one and a half and the sum of the average width of said bridging portion measured parallel to said longitudinal axis of the strip and the radius of said stem of said grommet.

6. The grommet strip in claim 5 wherein the length of said cutouts is at least 3.0 mm and the average width of said bridge is not more than 4.0 mm where the distances are measured in a direction parallel to said second axis.

7. The grommet strip in claim 5 wherein the majority of the grommets have cutouts associated therewith to partially silate the grommets from the strip.

8. The grommet strip in claim 2 further including a layer of material softer than said strip being formed with prearranged holes adapted for the stems of the grommets of the strip, being placed under said strip for at least a length along the longitudinal axis thereof, and constituting a damped grommet strip assembly arranged for use in a sports racket frame.

9. The grommet strip with said layer in claim 8 wherein the majority of the grommets have said associated cutouts to partially isolate the grommets from the strip.

10. The grommet strip with said layer in claim 8 wherein said layer is glued to the interior surface of the strip.

11. The grommet strip of claim 2 wherein the length of said cutouts is at least 6.0 mm and the average width of said bridging portion of the strip is more than 4.0 mm, wherein the distances are measured along the direction parallel to said second axis.

12. The grommet strip in claim 1 wherein a majority of the grommets have cutouts associated therewith to partially isolate the grommets from the strip.

13. The grommet strip of claim 1 wherein the cutouts define an elongated opening adjacent both sides of at least one grommet and said second axis.

14. The grommet strip in claim 6 wherein the length of each of said cutouts along the direction parallel to said second axis is at least three times the sum of the average width of said bridging portion of the strip, measured in a direction parallel to said longitudinal axis, and the diameter of said stem of said grommet.

15. The grommet strip in claim 1 further including a layer of material softer than said strip being formed with prearranged holes adapted to the stems of the grommets of the strip, being placed under said strip for at least a length along the longitudinal axis thereof, and constituting a damped grommet strip assembly arranged for use in a sports racket frame.

* * * * *